United States Patent [19]

Schmidt et al.

[11] Patent Number: 4,794,871

[45] Date of Patent: Jan. 3, 1989

[54] METHOD AND INSTALLATION FOR THE TREATMENT OF MATERIAL CONTAMINATED WITH TOXIC ORGANIC COMPOUNDS

[75] Inventors: Rüdiger Schmidt, Munich; Kurt Kugler, Markt Indersdorf, both of Fed. Rep. of Germany

[73] Assignee: Environment Protection Engineers, Inc., Southfield, Mich.

[21] Appl. No.: 170,582

[22] Filed: Mar. 18, 1988

Related U.S. Application Data

[63] Continuation of Ser. No. 766,707, Aug. 19, 1985, abandoned.

[51] Int. Cl.[4] ..... F23B 7/00

[52] U.S. Cl. ..... 110/341; 110/246; 110/210

[58] Field of Search ..... 110/235, 237, 246, 210, 110/211, 214, 215, 216, 341

[56] References Cited

U.S. PATENT DOCUMENTS

| | | | |
|---|---|---|---|
| 3,627,289 | 12/1971 | Erman | 110/246 |
| 3,848,548 | 11/1974 | Bolejack, Jr. et al. | 110/246 |
| 4,153,411 | 5/1979 | Isheim | 110/246 |
| 4,232,614 | 11/1980 | Fitch et al. | 110/246 |
| 4,245,571 | 1/1981 | Przewalski | 110/246 |
| 4,274,342 | 6/1981 | Nider | 110/246 |
| 4,395,958 | 8/1983 | Caffyn et al. | 110/246 |
| 4,517,906 | 5/1985 | Lewis et al. | 110/210 |
| 4,541,346 | 9/1985 | Culliford | 110/246 |

*Primary Examiner*—Henry C. Yuen

*Attorney, Agent, or Firm*—Frost & Jacobs

[57] ABSTRACT

Method and installation or apparatus for the treatment of material contaminated with toxic organic compounds in which the material is subjected to a thermal treatment to destroy or decompose the toxic compounds, the thermal treatment being carried out in two stages, i.e. a first stage in which the contaminated material is heated to a temperature of not more than 500° C. under pyrolysis conditions in an indirectly heated rotary furnace, and a second stage in which the solid residue remaining in the first stage is heated in a second furnace to a temperature of at least 500° C. until the concentration of toxic organic compounds in the residue is in the ppb range and preferably 1 ppb or less, and in which the gaseous reaction products of the first and second stages are supplied to a combustion chamber and there burnt at a temperature which is sufficient to completely destroy all the toxic organic compounds contained therein.

11 Claims, 1 Drawing Sheet

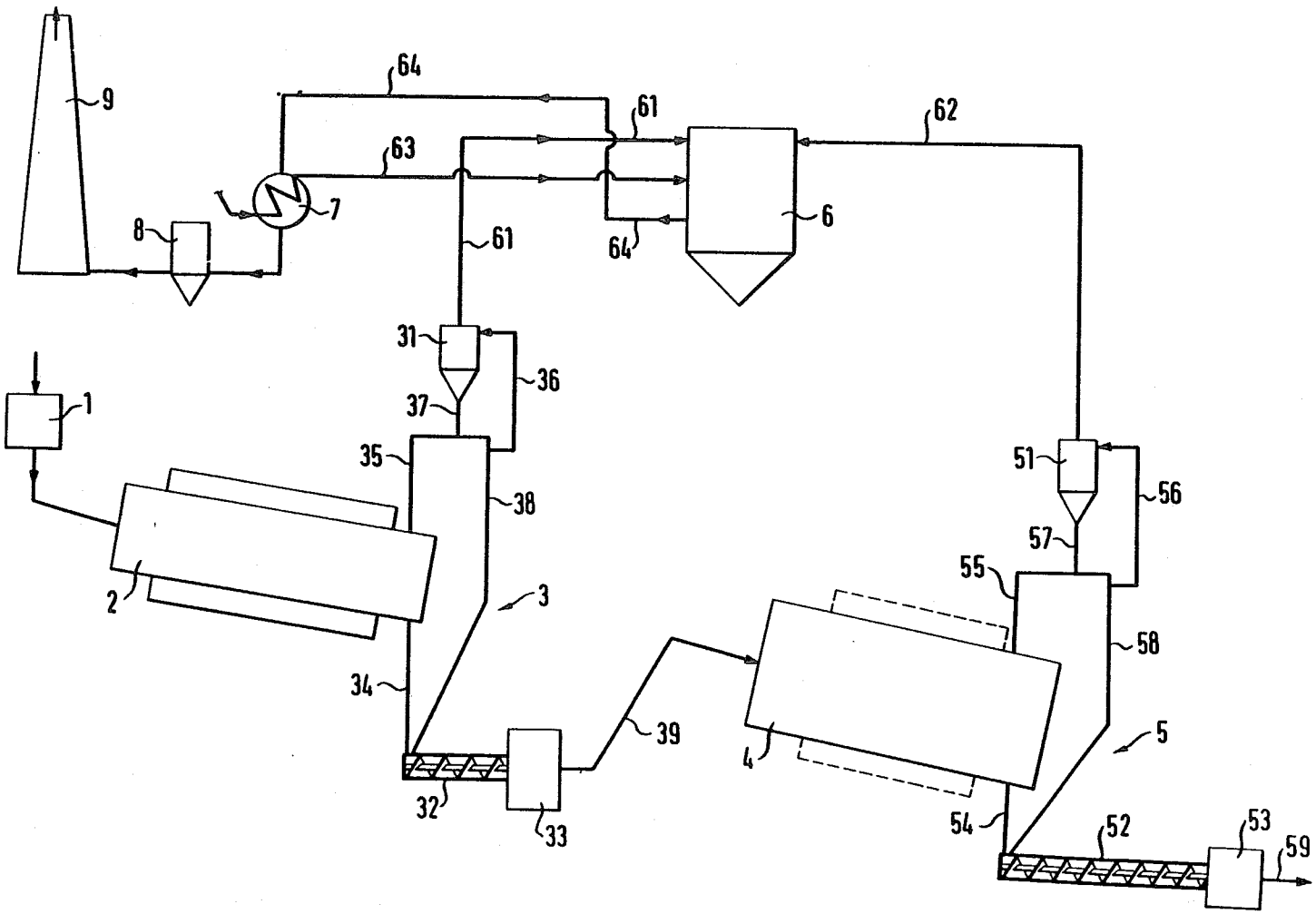
1
2
3
4
5
6
7
8
9
31
32
33
34
35
36
37
38
39
51
52
53
54
55
56
57
58
59
61
62
63
64

METHOD AND INSTALLATION FOR THE TREATMENT OF MATERIAL CONTAMINATED WITH TOXIC ORGANIC COMPOUNDS

This is a continuation of application Ser. No. 766,707, filed Aug. 19, 1985, now abandoned.

BACKGROUND OF THE INVENTION

1. Field of the invention

The invention relates to a method and an installation or apparatus for the treatment of material contaminated with toxic organic compounds in which the material is heated in a rotary furnace to thermally destroy or decompose the toxic compounds and in which the gaseous reaction products are separated from the solid reaction products and burnt in a combustion chamber.

2. Description of the prior art

In many industrial countries, but also in so called developing countries, there are larger and smaller areas or terrain contaminated or polluted with highly toxic organic substances. The most dangerous of these highly toxic organic compounds are those of the group comprising polychlorobiphenylenes (PCBs, dioxins, including tetrachlorodibenzodioxin (TCDD), furans and polycyclic aromatic hydrocarbons (PAHs). In some cases it was not until recent years that the danger of these substances for the health of humans was established.

Previously, however, in many cases for decades in the chemical industry waste materials were produced containing these highly toxic substances. These waste materials were usually stored in liquid or solid form in dumps or in wastewater ponds or sludge tank,, where in most cases they still are today. There are other relatively large areas in which the entire topsoil is contaminated by gas and dust emissions which were polluted with the highly toxic substances.

For ecological and health reasons it is therefore urgently necessary to detoxicate the contaminated areas by corresponding treatment of the entire toxicated earth and rock, contaminated waters and waste water and polluted rubbish and muds. Since enormous quantities of contaminated material are involved, a decisive factor in the implementation of corresponding recultivation programs is that the methods and installations used involve acceptable technical and economic expenditure, which means that they can be carried out with the minimum energy consumption and have at the same time a high efficiency.

Because of the extremely high toxicity of the substances and compounds mention the remainder of toxic substances inevitably remaining in the treated materials should not exceed the concentration of a few ppb (parts per billion). Only when this limit value has been reached or bettered can the contaminated material be reused or utilized.

A known method for the treating of material contaminated with toxic organic compounds which is however still in the experimental stage is the extraction method. In this method an attempt is made either with the aid of organic solvents, of steam or organic solvents and steam together to extract the toxic substance from the contaminated materials and then separate them from the extracts for example by evaporating the solvent or water. This method has however many disadvantages: the efficiency of the method is too low to enable the required limit value in the ppb range to be reached; the organic solvents necessary for the extraction are usually themselves toxic and it is forbidden by law for them to be introduced into the earth, water or air: the organic solvents must be driven out of the soil treated therewith again by a thermal treatment, condensed in a corresponding apparatus and this recovered, and this requires a high consumption of energy.

Another known method for the treatment of material contaminated with toxic organic compounds is burning. In this method the contaminated material is heated in a furnace, usually a directly heated rotary furnace, to a temperature far above 1000° C. and the flue gas thereby generated thermally cracked at a still higher temperature of about 1200° C. and with a residence time of at least 2 seconds to completely destroy the thermally very stable toxic compounds.

This known method also has serious disadvantages: The heating of large amounts of materials to temperatures of 1000° to 1200 ° C. requires an enormous amount of fuel, not only because of the high temperatures on their own but also because the burning of such stable compounds requires a great deal of oxygen so that large quantities of air must be transported into the combustion chamber and heated. Inevitably a high ballast component is thereby entrained which must also be heated to these high temperatures, i.e. the nitrogen of the air which does not participate in the combustion operation. The specific energy requirement with this method is thus extremely high, making the overall method uneconomical. A further disadvantage of the known burning method is that the materials which are usually moist on introduction into the combustion furnace because of the intense thermal radiation in the furnace very rapidly become incrusted on the surface. The incrustation makes the surface of the materials increasingly dense and thus increasingly impermeable to gases which are to be driven out of the interior of the material and into the furnace atmosphere and withdrawn from the latter. Consequently, the incrustation of the material prevents an effective detoxication.

One object of this invention is therefore to provide a method for the treatment of material contaminated with toxic organic compounds which is more economical than the hitherto known methods, has a lower energy requirement and a higher efficiency.

Another object of this invention is to provide a method with which it is possible to reduce the concentration of toxic organic compounds in the material treated to the ppb range, preferably to 1 ppb or below.

A further object of this invention is to provide an installation or apparatus for the treatment of material contaminated with toxic organic compounds with which the method according to the invention can be carried out in simple and economical but at the same time effective manner.

A still further object of this invention is finally to provide an installation for the treatment of material contaminated with toxic organic compounds which is mobile and in the case of an accident or catastrophe can rapidly be brought to the place of use.

Still further objects of this invention may be seen from the description in this specification and the attached drawing.

BRIEF DESCRIPTION OF THE DRAWING

FIG. 1 is a schematic illustration of the installation according to the invention with its individual aggregates.

SUMMARY OF THE INVENTION

In the method according to the invention the thermal treatment of the contaminated material takes place in two stages, i.e. a first stage in which the contaminated material is heated in a rotary furnace with substantial exclusion of oxygen to a temperature of not more than 500° C. and thereby simultaneously dried, and a second stage in which the solid residue remaining after the treatment of the material in the first stage is heated in a second furnace to a temperature of at least 500° C. until the concentration of toxic organic compounds in the residue has reached a value which no longer has a toxic action and which is preferably 1 ppb or less. The gaseous reaction products both of the first stage and of the second stage are supplied to a combustion chamber and there burnt in an oxygen-containing atmosphere at a temperature which is sufficient to completely destroy all the toxic organic compounds contained therein.

The installation according to the invention for the treatment of material contaminated with toxic organic compounds comprises an introduction system for supplying and introducing the contaminated material into a first degassing means, a rotary furnace as first stage for the thermal treatment of the contaminated material, a discharge system for the separate discharge and withdrawal of the gases formed in the first stage and of the solid residue, an introduction system for supplying and introducing the solid residue of the first stage into a second heat treatment means, a second furnace as second stage for the thermal treatment of the contaminated material, a discharge system for the separate discharge and withdrawal of the gases formed in the second stage and of the solid residue, a combustion chamber for burning the gases formed in the first and second stages and means for supplying the gases into the combustion chamber and withdrawing the flue gases from the combustion chamber.

DESCRIPTION OF THE PREFERRED EMBODIMENTS

In the first stage of the thermal treatment of the contaminated material in which the operation is carried out with substantial exclusion of oxygen the material is already largely degassed by pyrolysis. The contaminated material is preferably heated to a temperature between 200° and 500° C. The pyrolysis carried out in the first stage is preferably performed in an indirectly heated rotary drum reactor These pyrolysis conditions are relatively mild, which minimizes the energy requirement and ensures at the same time that the material usually introduced in the moist state is not incrusted but remains gas-permeable even at its surface in contact with the heated surface of the rotary drum reactor so that the degassing of the contaminated material takes place not only in the region of its surface but uniformly also in the interior and over the entire cross-section of said contaminated material.

The indirect heating of the rotary drum reactor of the first stage can take place for example with the aid of a suitable heat carrier, for example with the aid of flue gases, also employing the flue gases generated in the method itself in the combustion chamber, or by means of a salt melt or electrically or in another manner known to the expert.

The residence time of the contaminated material in the first stage, i.e. in the indirectly heated rotary drum reactor, is expediently so dimensioned that the concentration of toxic organic substances in the "pyrolysis coke" emerging from the first stage as solid residue reaches a minimum characteristic for the chosen pyrolysis temperature, which however does not exceed 500° C., which is not substantially reduced even when the material remains in the rotary furnace for any desired time. In general this residence time is in the region between 0.5 and 1.5 hours.

The pyrolysis gas formed in the first stage is continuously withdrawn, freed from entrained dust by means of a conventional gas cleaning plant, for example a cyclone, introduced into a combustion chamber into which the necessary combustion air, preferably preheated, is simultaneously introduced, and, in the combustion chamber, burnt at a temperature sufficient to completely destroy all the toxic organic compounds contained therein. This temperature is usually more than 1200° C. with a residence time of the gases to be burnt in the combustion chamber of at least 2 seconds.

The solid residue emerging from the indirectly heated rotary furnace in the pyrolysis of the contaminated material in the first stage is introduced by means of a discharge system consisting of pipes and conveying means together with the dust component separated from the pyrolysis gas by means of an introduction system consisting of pipes and conveying means into a second furnace in continuous or discontinuous manner, said second furnace representing the second stage of the thermal treatment of the contaminated material. This second furnace may be a directly or indirectly heated rotary drum reactor. In the second stage the contaminated material which has not yet been completely degassed i the first stage is subjected to a second complete degassing, this being carried out at a temperature of at least 500° C., preferably between 500° and 1000° C. or more. The second stage of the thermal treatment can take place under pyrolysis conditions, i.e. with substantial exclusion of oxygen; it may however also be carried as combustion in the presence of oxygen. The residence time of the material to be treated in the second stage lies in general between about 0.5 and 2 hours.

If the second stage is carried out as pyrolysis the solid residue coming from the first stage is heated to a temperature of at least 600° C., preferably between 700° and 850° C. If however the second stage is carried out as burning, the material is heated to a temperature of at least 900° C. in the second stage is carried out under pyrolysis conditions an indirectly heated rotary drum reactor is preferably again used. If the second stage however is carried out as combustion a directly heated furnace is preferably used, either a directly heated rotary drum reactor or a fluidized bed furnace.

The pyrolysis or combustion or flue gases forming in the second stage are in turn continuously withdrawn, freed in a conventional dedusting plant, for example a cyclone from entrained dutt and supplied to the same combustion chamber as the pyrolysis gases of the first stage where, together with the pyrolysis gases of the first stage, they are burnt under the same conditions as described above. The flue gases forming in the burning of the gases are withdrawn jointly from the combustion chamber and preferably led through a heat exchanger where they give up part of their heat content to a second medium flowing through the heat exchanger, for example the combustion air supplied to the combustion chamber. The cooled flue gases emerging from the heat exchanger are thereafter conducted through a gas washer and there quenched in a manner known per se and subsequently discharged into the surrounding atmosphere through a suction forced draught, i.e. a chimney stack with incorporated suction fan.

The use of the forced draught means that the entire installation is subjected to a slight reduced pressure which in turn means that no toxic gases can escape before their thermal destruction into the environment but that if there are any leaks in the individual aggregates or the pipes and fittings connecting them air is merely sucked in and can enter the installation.

The dust separated from the pyrolysis or flue gases of the second stage is combined by means of a discharge system constructed completely in accordance with the discharge system described above of the first stage with the solid residue emerging from the second furnace and together with the residue conveyed with the aid of suitable pipes and conveying means to a storage location or a storage bunker from whence the now decontaminated material, whose content of toxic organic compounds is in the ppb range, preferably 1 ppb or less, is transported back to its original dump or can be used or reutilized in any other desired way.

Before the contaminated material with the aid of the introduction system consisting of pipes and conveying means is supplied to the first stage of the thermal treatment, depending on the particular consistency and composition of the material it may be subjected to a mechanical and/or chemical pretreatment. The mechanical pretreatment may be by comminuting, sorting and/or classifying the material, the term "mechanical" also being meant to include for example the removal of metals by means of a magnet.

The chemical pretreatment of the contaminated material can take place by adding basic or acidic substances serving as means to adjust a desired pH value. The most important example in practice for such chemical pretreatment is the addition of lime or limestone to chemically bind acids, acidic gases and acid anhydrides and thus prevent from the start or reduce to an absolute minimum the formation of acidic gases, in particular sulphur dioxide and nitrogen oxides. If the flue gases resulting in the method according to the invention nevertheless contain some acidic gases such as sulphur dioxide or nitrogen oxides, these acidic gases are washed out by quenching in the gas washer already described above and thereby separated out so that they cannot pass into the environment.

Although the procedure according to the invention substantially eliminates in the first stage of the thermal treatment an incrustation of the surface of the contaminated material, it may be expedient with contaminated materials which incrust particularly easily to incorporate into the indirectly heated rotary furnace of the first stage fittings such as entrained rollers with or without welded-on screw threads, wipers, scrapers or rakes, which loosen any incrusted material and prevent the material sticking to the hot inner wall of the furnace. If the contaminated material has a density which is too low, which would impair the heat transfer from the furnace wall to the material, because of there weight the fittings described would compact the material and thus ensure improved heat transfer. Fittings of the type described are explained in German patent application No. P 34 07 236.5 of Feb. 2, 1984, to the content of which express reference is hereby made.

Preferably, the content of toxic organic compounds of the material to be treated is continuously measured by analyzers operating continuously or discontinuously directly prior to the entry of material into the rotary furnace of the first stage, directly prior to the entry of the solid residue of the first stage into the second furnace (second stage), after the exit of the solid residue and of the gases forming in the second stage from the second furnace and after the exit of the flue gases from the combustion chamber, and thus checked and monitored, and the measured values obtained are passed to a process computer and there compared with the desired reference values. The furnace temperatures and the residence times of the material in the first and second stage and the temperature in the combustion chamber are controlled with the aid of the computer in such a manner that the concentration of toxic organic compounds in the treated material and exhaust air is in the ppb range and preferably 1 ppb or less.

With the aid of the method according to the invention compared with the known single-stage combustion methods a great deal of additional energy is saved because most of the toxic organic compounds are converted to the gaseous phase in the first stage carried out under pyrolysis conditions and can be selectively burnt under defined and thus easily optimizable conditions whilst in the second stage according to the invention it is necessary to supply only enough energy to heat the residue of the first stage either directly to a temperature of about 1000° C. or above, at least however 900° C., or indirectly to a temperature of at least 500° C., preferably at least 600° C., and in particularly preferred manner to a temperature between 700° and 850° C., with correspondingly longer residence time. The desired limit value, or that prescribed by law, of the concentration of toxic organic compounds is achieved for the first time according to the invention with acceptable economical expenditure. The division of the thermal treatment of the contaminated material according to the invention into two stages permits a particularly effective control of the pyrolysis and combustion with minimum energy consumption and at the same time maximum efficiency. In the known single-stage combustion methods the pure energy costs are about 100 US $ per ton of the material to be treated whereas with the method according to the invention only about ⅓ of these costs are incurred.

The installation or apparatus according to the invention will be explained hereinafter with the aid of the drawing (FIG. 1):

From a supply bunker or a charging means (not shown) the contaminated material is first conveyed into a container 1 in which it is subjected to a mechanical and/or chemical pretreatment, for example comminuted and mixed with lime or limestone for neutralizing acidic constituents. From the pretreatment station 1 the material is introduced continuously or discontinuously into the indirectly heated rotary drum reactor 2 by means of an introduction system (not shown) consisting of pipes and conveying means. In the rotary drum reactor 2 the first stage of the thermal treatment of the material takes place under pyrolysis conditions, i.e. with substantial exclusion of oxygen. The contaminated material is heated to a temperature of not more than 500° C. and simultaneously dried. Substantially no incrustation of the material occurs. The pyrolysis gases forming in the first stage are continuously withdrawn from the rotary drum reactor 2 through the pipes 35 and 36 and supplied to a cyclone 31 in which the dust entrained by the gases is separated and through the pipes 37, 38 combined with the solid residue of the first stage. The solid residue remaining in or after the first stage is conveyed through the pipe 34 and the conveying screw 32 together with the dust returned through the pipes 37, 38 to the intermediate container 33. The cyclone 31, the conveying screw 32, the intermediate container 33 and the pipes 34–38 form together the discharge system 3 with the aid of which the pyrolysis products of the first stage are withdrawn separately from the rotary drum reactor 2 and supplied to the further aggregates.

The solid residue is conducted from the intermediate container 33 by means of an introduction system consisting of a pipe 39 and conveying means (not shown-)into the second furnace 4 and there heated to a temperature between 500° and 1000° C. In the second furnace 4, which may be a directly or indirectly heated rotary furnace and represents the second stage of the thermal treatment of the contaminated material, a second degassing of the material takes place. The furnace atmosphere in the second furnace may contain oxygen; the second stage is then carried out as burning. The second stage may however also be carried out with substantial exclusion of oxygen, i.e. under pyrolysis conditions. The pyrolysis or flue gases forming in the second stage are withdrawn via pipes 55, 56 continuously from the furnace 4 and supplied to a cyclone 51 in which they are freed from entrained dust. The separated dust is returned via the pipes 57, 58 and combined with the solid residue remaining in the second stage which is removed via the pipe 54 and supplied by means of a conveying screw 52 to a bunker 53. The content of toxic organic compounds in the decontaminated material stored in the bunker 53 is in the ppb range and preferably 1 ppb or less. The decontaminated material is discharged through the pipe 59 and carried away. The cyclone 51, the conveying screw 52, the bunker 53 and the pipes 54–59 form together the discharge system 5 which follows the second furnace 4.

The pyrolysis gas withdrawn from the first stage is supplied via the pipe 61 and the pyrolysis or flue gas withdrawn from the second stage is supplied via the pipe 62 to the combustion chamber 6 into which via the pipe 63 the combustion air necessary for burning the gases is supplied. The flue gases forming in the combustion in the combustion chamber 6 are withdrawn via the pipe 64 and supplied to a heat exchanger 7 where they give off part of their heat content to the combustion air flowing into the pipe 63 to preheat the combustion air and reduce the amount of energy which must be supplied to the combustion chamber to maintain the necessary combustion temperature. The flue gases emerging from the heat exchanger 7 are supplied to a gas washer 8 and there quenched to wash out from the flue gases in particular acidic gases. After the quenching the cleaned flue gases pass to the chimney stack 9 formed as forced draught and equipped with a suction fan which generates and maintains a slight reduced pressure in the entire installation.

Preferably, the individual aggregates (1, 2, 3, 4, 5, 6, 7, 8 and 9) are detachably connected together so that they may be combined individually or in groups on one or more chassis or on one or more land or marine vehicles, thus making the entire installation mobile so that it can easily be brought to the necessary place of use in tee event of a catastrophe.

What is claimed is:

1. Method for the thermal treatment of earth, rock, water, waste materials, waste waters, sludges, and mixtures thereof contaminated with polychlorobiphenylenes, dioxines, tetrachlorobenzodioxin, furans, polycyclic aromatic hydrocarbons, and mixtures thereof, wherein the thermal treatment of the contaminated material is conducted in two stages, comprising the steps of heating said contaminated material in a first stage in an indirectly heated rotary drum reactor with substantial exclusion of oxygen to a temperature of not more than 500° C. and simultaneously drying said material, and in a second stage separately heating solid residue remaining after the treatment of the material in the first stage to a temperature of at least 500° C. until the concentration of toxic organic compounds in the residue has reached a value in the parts per billion range, and delivering gaseous reaction products both of the first and of the second stages to a combustion chamber and burning said gaseous reaction products in an oxygen-containing atmosphere at a temperature sufficient to completely destroy all toxic organic compounds contained therein.

2. Method according to claim 1, wherein the contaminated material is heated in the first stage to a temperature of between 200° to 500° C.

3. Method according to claim 1, wherein the second stage of the thermal treatment is carried out in an indirectly heated rotary drum reactor under pyrolysis conditions.

4. Method according to claim 3, wherein the solid residue is heated in the second stage to a temperature of at least 600° C., preferably to a temperature between 700° and 850° C.

5. Method according to claim 1, wherein the second stage of the thermal treatment comprises a burning of the solid residue originating from the first stage.

6. Method according to claim 5, wherein the burning of the solid residue is carried out in a directly heated furnace.

7. Method according to claim 6 wherein the burning of the solid residue is carried out in a directly heated rotary drum reactor or a fluidized bed furnace.

8. Method according to claim 6 wherein the solid residue is heated in said second stage to a temperature of at least 900° C.

9. Method according to claim 1, wherein said rotary furnace used in the first stage is indirectly heated by means of flue gases obtained by burning said gaseous reacting products.

10. Method according to claim 1, wherein the contaminated material is subjected prior to the thermal treatment to a mechanical and/or chemical pretreatment.

11. Method according to claim 10, wherein the mechanical pretreatment is effected by comminuting, sorting and/or classifying the material and wherein the chemical pretreatment is effected by adding basic or acidic substances which serve as means for adjusting a desired pH value.

* * * * *